US006789859B1

(12) United States Patent
Ho

(10) Patent No.: US 6,789,859 B1
(45) Date of Patent: Sep. 14, 2004

(54) USER ASSEMBLED METALLIC CABINET

(75) Inventor: Chiao-Ling Ho, Taichung (TW)

(73) Assignee: Taiwan Ultra Power Industries Ltd., Taichung (TW)

( * ) Notice: Subject to any disclaimer, the term of this patent is extended or adjusted under 35 U.S.C. 154(b) by 0 days.

(21) Appl. No.: 10/413,296

(22) Filed: Apr. 15, 2003

(51) Int. Cl.[7] ..... A47B 43/00
(52) U.S. Cl. ..... 312/257.1; 312/263
(58) Field of Search ..... 312/257.1, 263, 312/326, 329, 351

(56) References Cited

U.S. PATENT DOCUMENTS 2,424,217 A * 7/1947 Galloway ..... 451/123
3,186,782 A * 6/1965 Ullman, Jr. ..... 312/263
4,836,626 A * 6/1989 Taylor et al. ..... 312/257.1
5,921,646 A * 7/1999 Hwang ..... 312/263
5,975,660 A * 11/1999 Tisbo et al. ..... 312/263
6,478,391 B1 * 11/2002 Stoever ..... 312/265.5

* cited by examiner

*Primary Examiner*—Peter M. Cuomo
*Assistant Examiner*—Stephen Vu
(74) *Attorney, Agent, or Firm*—Rosenberg, Klein & Lee

(57) ABSTRACT

A metallic cabinet includes a bottom board, two lateral boards detachably joined to lateral edges of the bottom board, a lower rear board detachably joined to a rear edge the bottom board, a top board detachably joined to tops of the lateral boards, an upper rear board detachably joined to an upper edge of the lower rear board, a supporting rod detachably joined to front portions of inward sides of the lateral boards at two ends, and at least one door pivoted to the bottom and the top boards at two ends thereof respectively; the above parts are formed with corresponding holes and engaging protrusions shaped such as to be detachable from, and joinable to, each other, and are not joined together when the cabinet is packed for transportation or storage.

3 Claims, 8 Drawing Sheets

USER ASSEMBLED METALLIC CABINET

BACKGROUND OF THE INVENTION

1. Field of the Invention

The present invention relates to a metallic cabinet, more particularly one, of which various parts are not joined together when it is packaged for saving space in transportation or storage, and which is easy to assemble and easy to dismantle.

2. Brief Description of the Prior Art

Increase in population causes reduction to space people can have in living and working. People in urban areas inevitably face the task of using space economically, e.g. very high buildings are built in big cities to overcome the problem that there is not enough land available for large population, and many devices such as beds, bicycles, and strollers are made foldable so that they can occupy less space when not used or in storage. Various cabinets have been developed to provide more rooms for allowing more objects to be stored with limited area. Metallic cabinets are very common and popular, especially in offices, because they are strong, less expensive than wooden ones.

However, conventional metallic cabinets are usually assembled with the parts thereof being joined together by means of welding or rivets therefore the cabinets can't be easily dismantled, and the assembling has to be finished in factories by the manufacturers. Consequently, such metallic cabinets occupy relatively much space in transportation and storage, causing increase to the cost. And, it is inconvenient for the consumers to move such metallic cabinets homes from the shop because the cabinets have already been assembled. Consequently, the consumers might have to have the cabinets sent home by truck.

SUMMARY OF THE INVENTION

It is a main object of the present invention to provide a metallic cabinet, of which various parts are not joined together for saving space when it is packaged in the factories, and which is easy to assemble and easy to dismantle; thus, the consumers can move the cabinet home easily, and assemble it by themselves at home.

The cabinet includes a bottom board, two lateral boards joined to lateral edges of the bottom board, a lower rear board joined to a rear edge the bottom board, a top board joined to tops of the lateral boards at lateral edges, an upper rear board joined to an upper edge of the lower rear board at a lower edge, a supporting rod joined to front portions of inward sides of the lateral boards at two ends, and doors pivoted to the bottom and the top boards; the above parts have engaging holes, and engaging protrusions corresponding to the engaging holes on portions thereof that abut each other after assembly of the cabinet; the protrusions are made to be easily separably engaged with the engaging holes.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
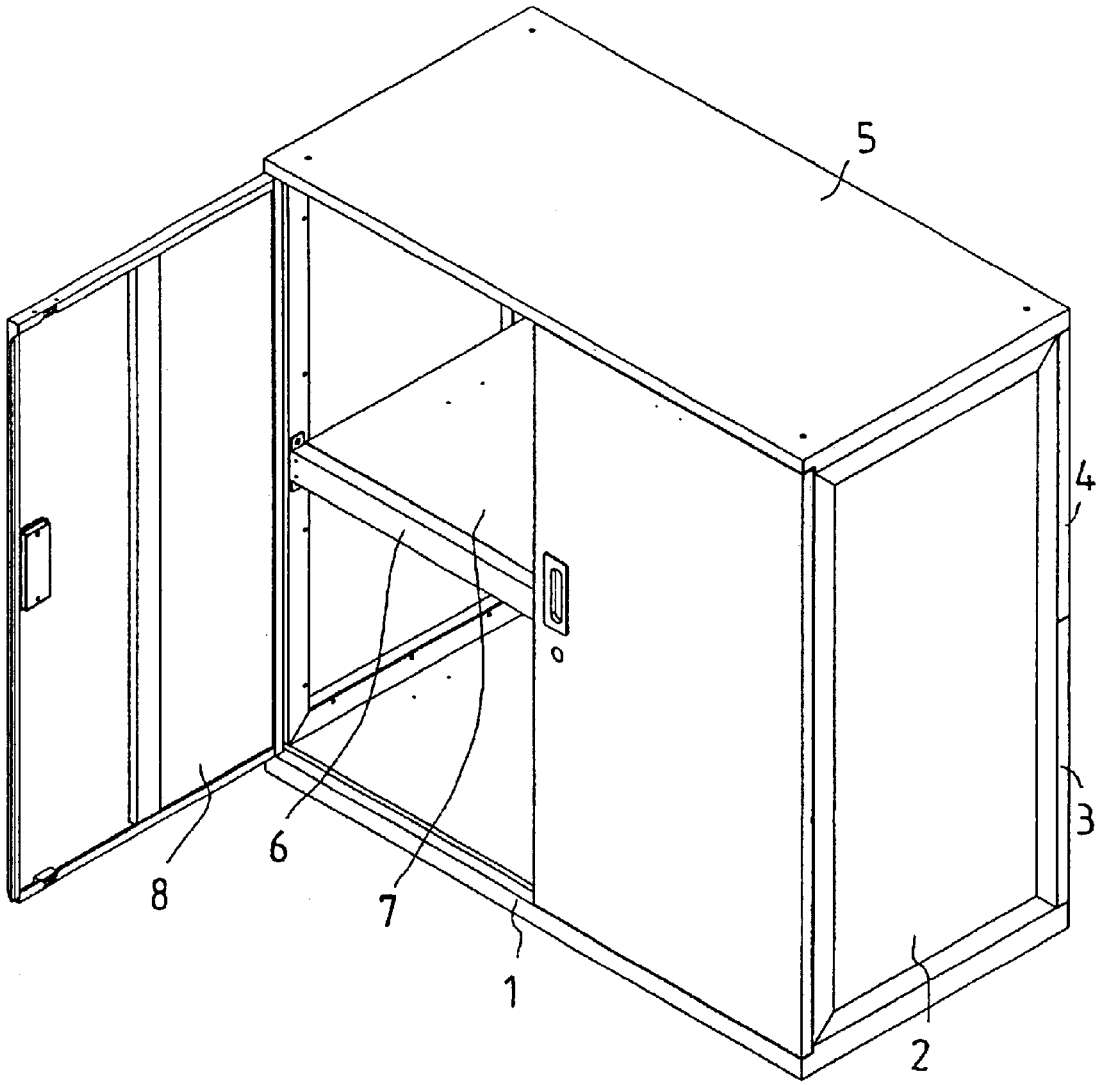
FIG. 1 is a perspective view of a metallic cabinet according to the present invention.

Referring to FIGS. 1 to 6, a preferred embodiment of a metallic cabinet in the present invention includes a bottom board 1, two lateral boards 2, a lower back board 3, an upper back board 4, a top board 5, a supporting rod 6, a separating board 7, and two doors 8.

Figure 2:
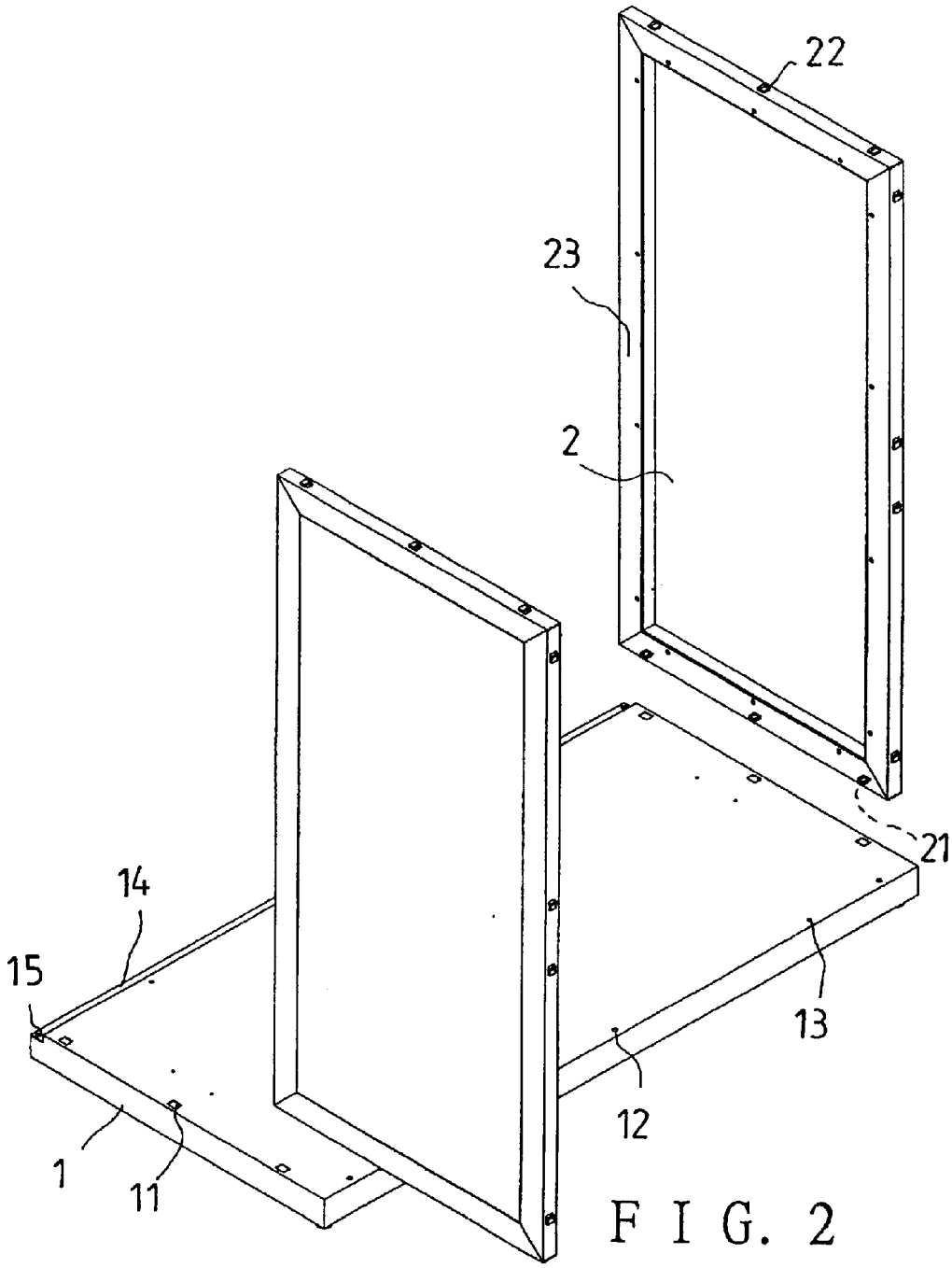
FIG. 2 is a view of the metallic cabinet of the present invention under a first step of assembly.
Figure 8:
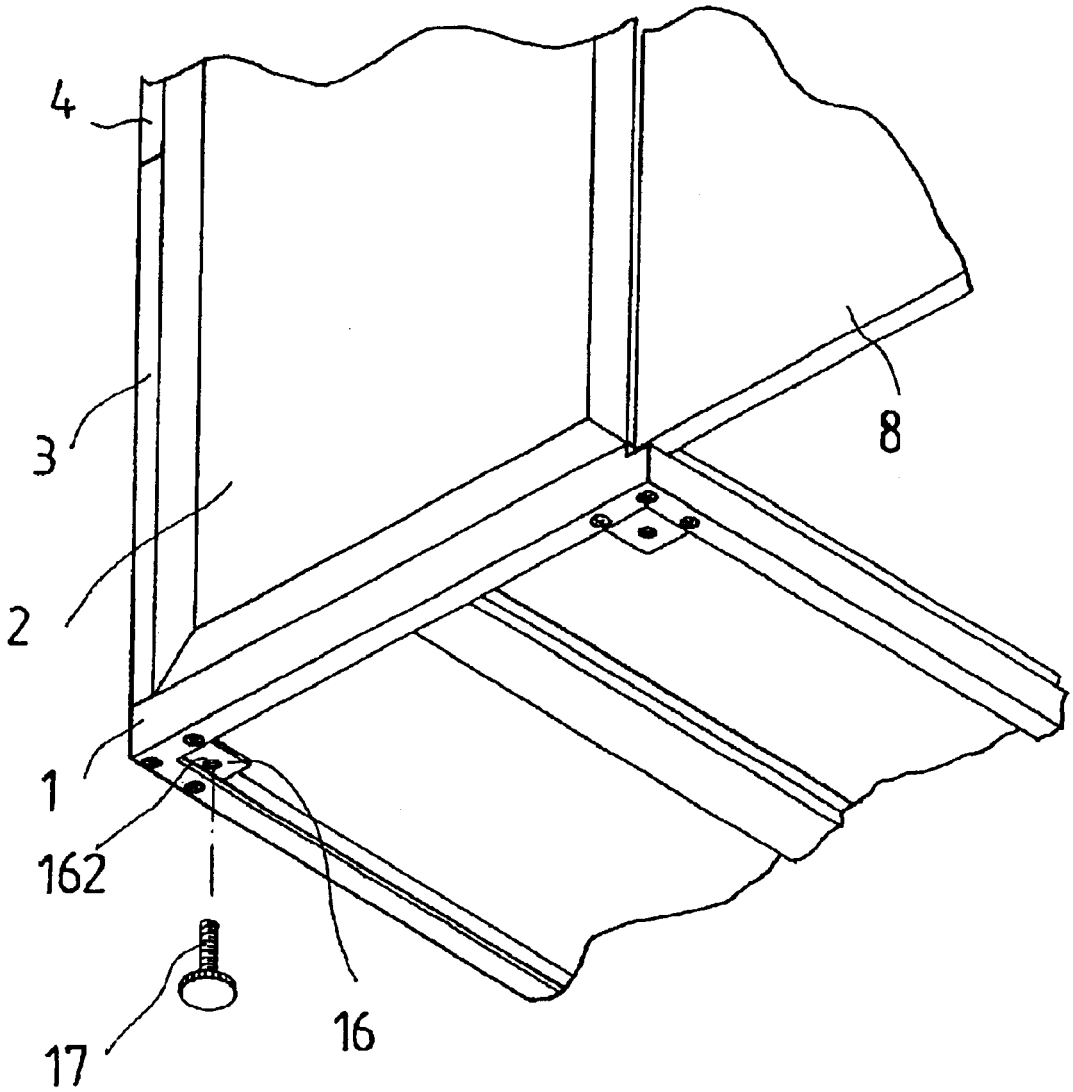
FIG. 8 is a partial perspective view of the metallic cabinet of the present invention in use.

Referring particularly to FIG. 2, the bottom board 1 has several engaging holes 11 on the upper side of two lateral edges, several insertion holes 12, and screw holes 13 on the upper side of a rear edge, a step-shaped portion 14 on an upper side of a front, and pivotal holes 15 on upper sides of two ends of the step-shaped portion 14. Referring to FIG. 8, four connecting plates 16 are provided, each of which has a post 161 on one side, and a screw hole 162 on the other side; the connecting plates 16 are secured to four corners of the bottom plate 1 with the screw holes 162 facing down, and legs 17 are screwed into respective ones of the screw holes 162.

Each of the lateral boards 2 has screw holes 23 on the inward side of a front edge thereof, hooked engaging protrusions 21 on the lower end and corresponding to the engaging holes 11 of the bottom board 1, hooked engaging protrusions 22 on the upper end; the upper and the lower hooked engaging protrusions 22, and 21 are directed to opposite directions.

Figure 3:
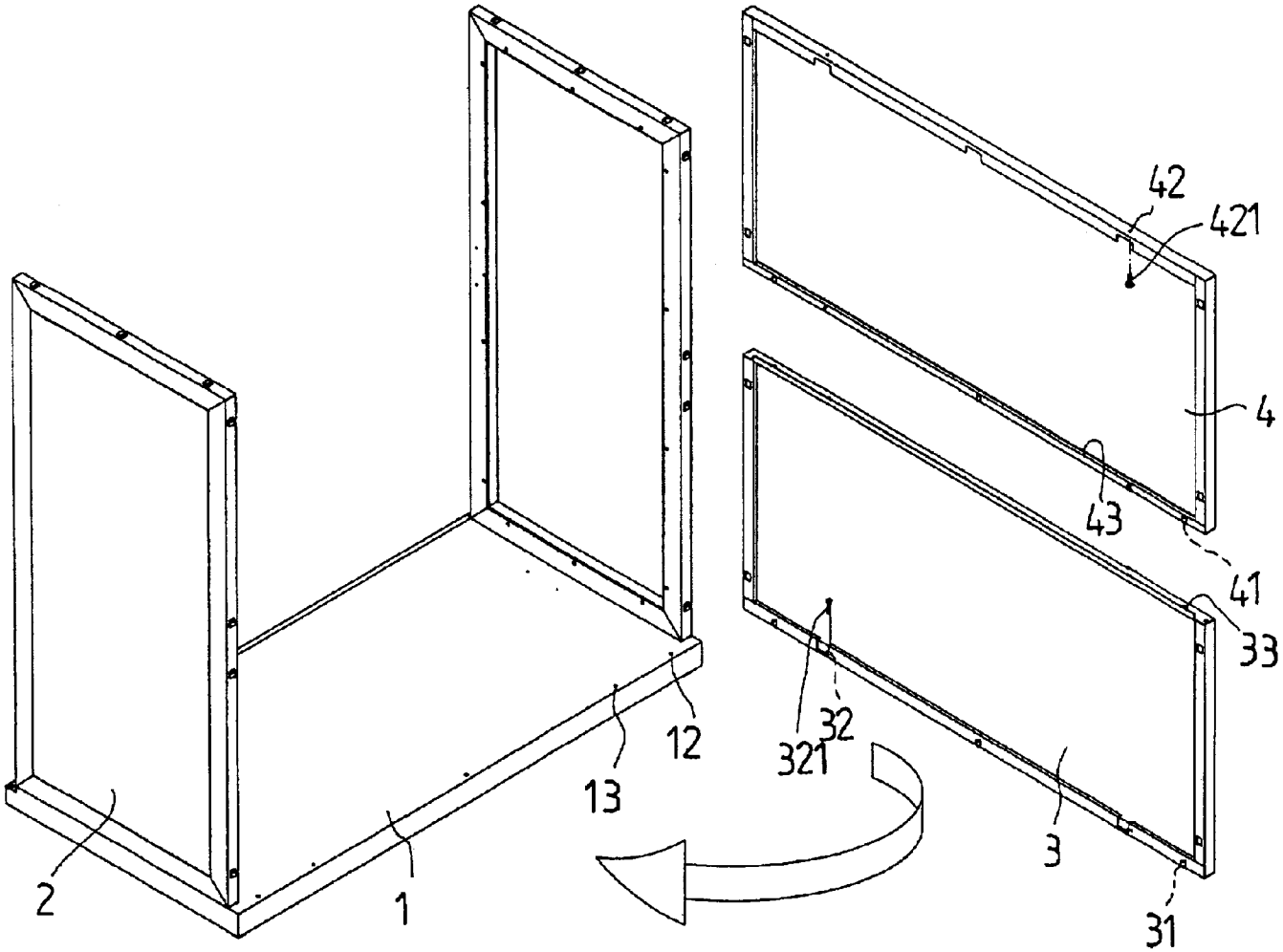
FIG. 3 is a view of the metallic cabinet of the present invention under a second step of assembly.

Referring particularly to FIG. 3, formed on a lower edge of the lower back board 3 are insertion posts 31, and through holes 32, respectively corresponding to the insertion holes 12, and the screw holes 13 of the bottom board 1; screws 321 are to be screwed into the through holes 32 and corresponding screw holes 13 to secure the lower back board 3 to the bottom board 1; formed on the upper edge of the lower back board 3 are insertion holes 33.

Formed on a lower edge of the upper back board 4 are insertion posts 41, corresponding to the insertion holes 33 of the lower back board 3; formed on the upper edge of the upper back board 4 are insertion holes 42, which allow screws 421 to be passed through; the upper back board 4 is further formed with a supporting protrusion 43 along the inward side of the lower edge thereof.

Figure 4:
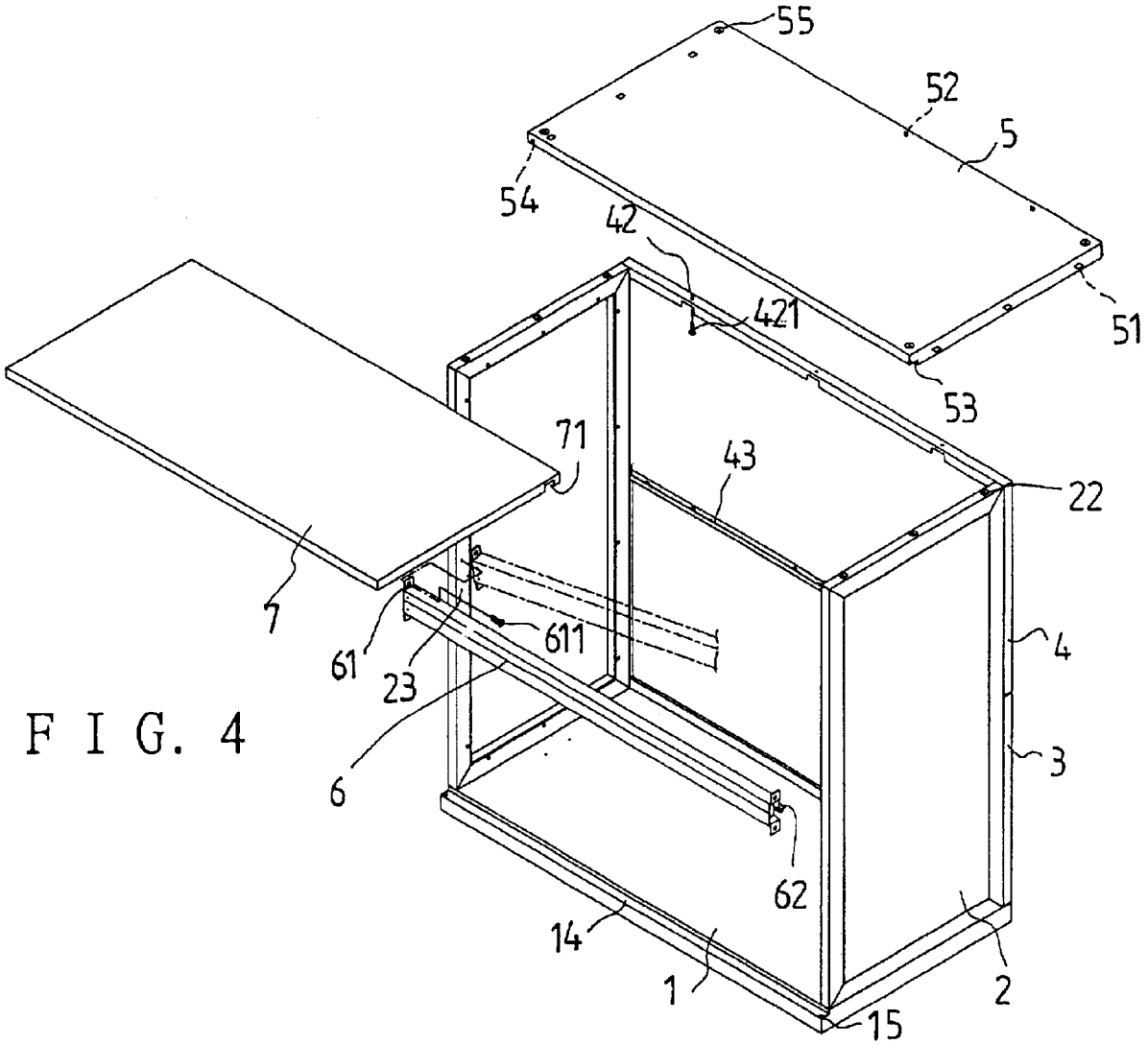
FIG. 4 is a view of the metallic cabinet of the present invention under a third step of assembly.
Figure 5:
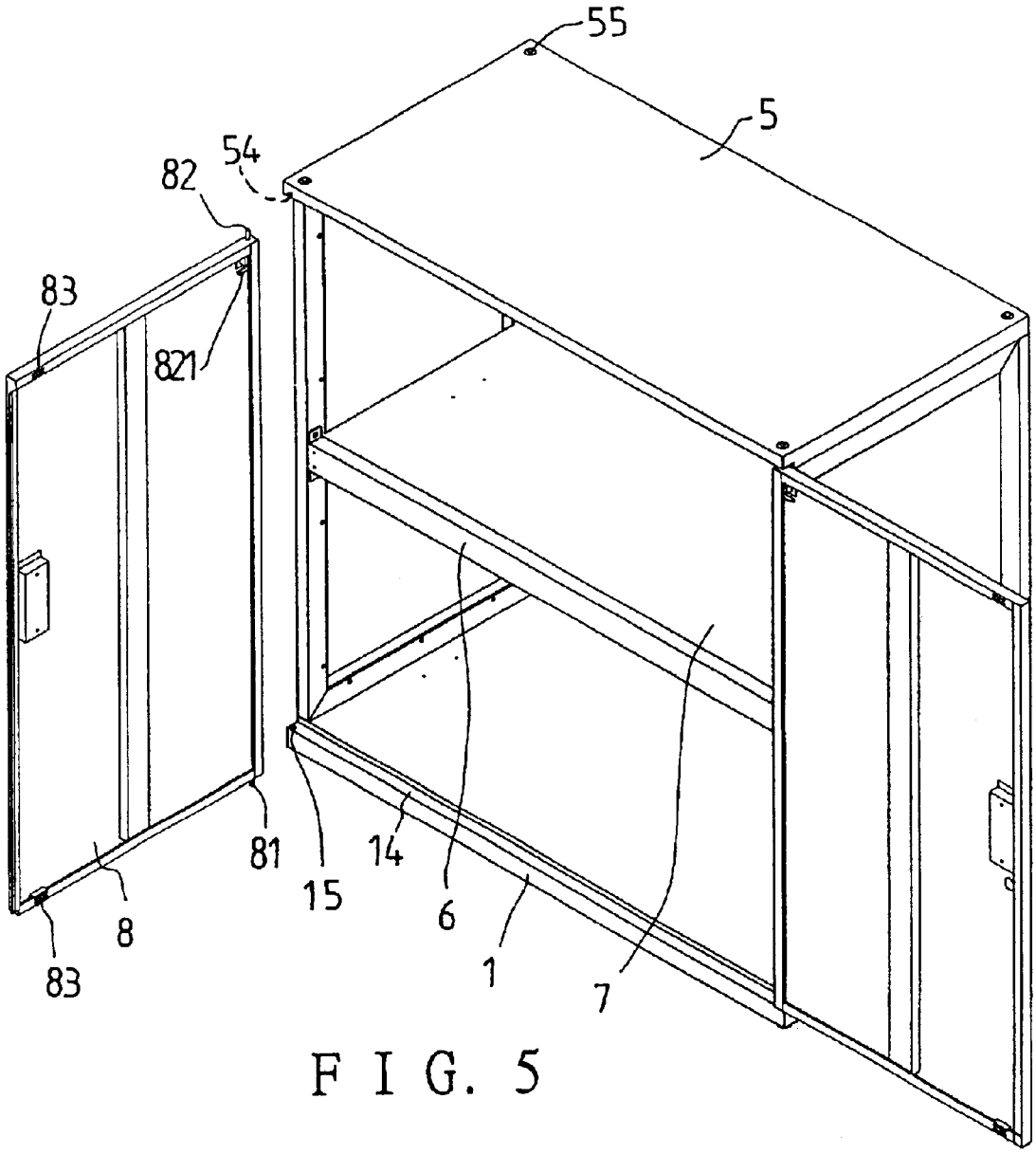
FIG. 5 is a view of the metallic cabinet of the present invention under a fourth step of assembly.

Referring particularly to FIG. 4, the top board 5 has engaging holes 51 corresponding to the hooked engaging protrusions 22 of the lateral boards 2 on the lower side of two lateral edges thereof, screw holes 52 corresponding to the insertion holes 42 of the upper back board 4 on the lower side of a rear edge thereof, a step-shaped portion 53 on a lower side of the front edge, and pivotal holes 54 on lower sides of two ends of the step-shaped portion 53. The top board 5 further has connecting holes 55 on upper sides of four corners thereof, aligned with the posts 161 and screw holes 162 of the connecting plates 16 of the bottom board 1.

Figure 6:
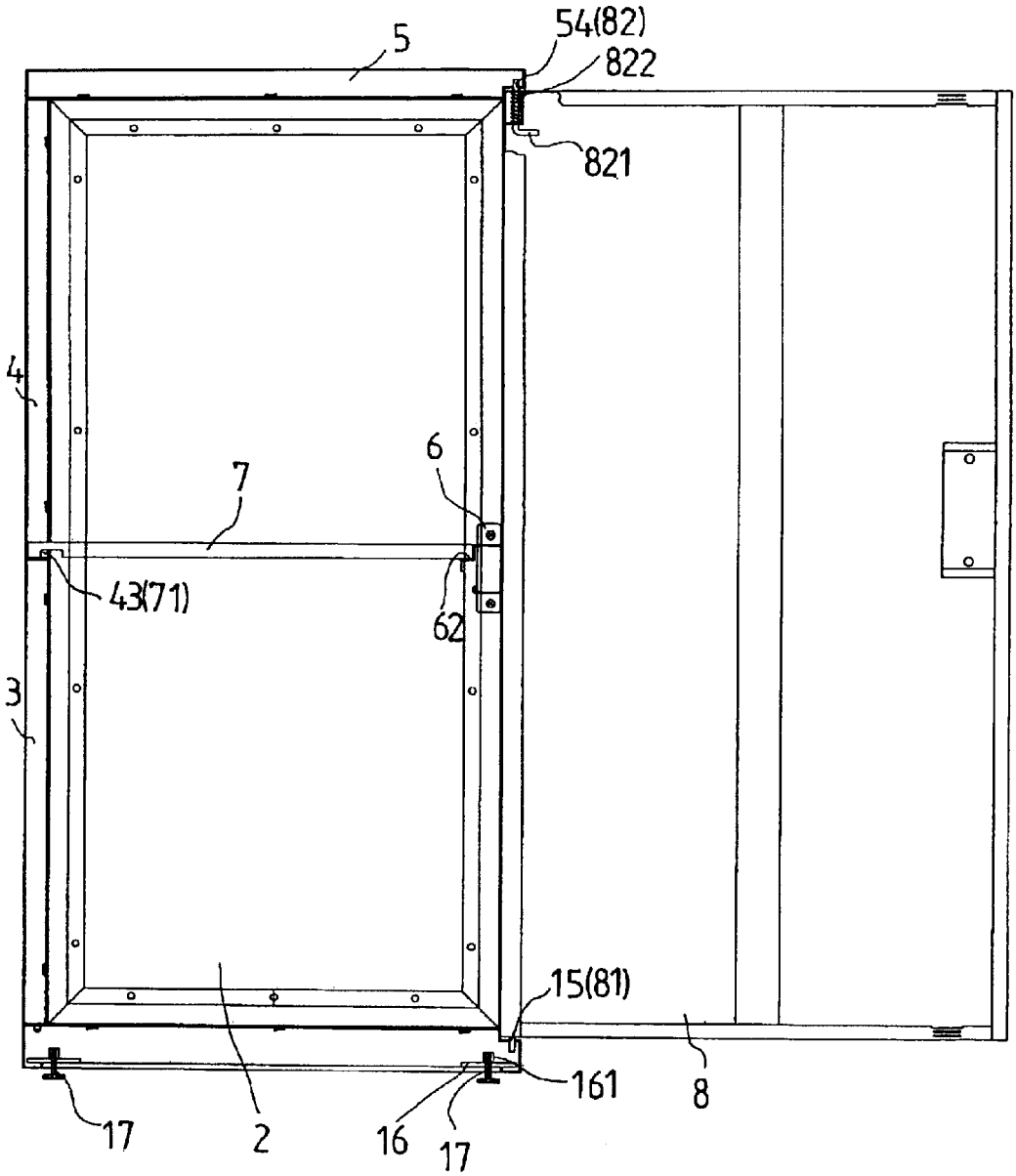
FIG. 6 is a view of the metallic cabinet of the present invention under a fifth step of assembly.

Referring particularly to FIGS. 4, and 6, the supporting rod 6 has through holes 61 corresponding to the screw holes 23 of the lateral boards 2 at two ends thereof, and a supporting protrusion 62 on an inward edge thereof.

The separating board 7 is shaped so as to fit closely in a space defined by the lateral boards 2, the upper back board 4, and the supporting rod 6 when the rod 6 and the boards 2, and 4 are joined together; thus, the separating board 7 is held in position by means of the supporting protrusions 43, and 62. The separating board 7 further has an engaging portion 71 near to the rear edge thereof.

Each of the doors 8 has upper and lower pivotal posts 82, and 81 on a top, and a bottom of a rear portion thereof, and magnetic members 83 on inward sides of upper and lower edges thereof; each upper pivotal posts 82 are biased to project upwards from the door 8 by means of an elastic element 822, and is formed with a pulled portion 821 so that it can be moved into the door 8 by means of exerting force on the pulled portion 822 against the elastic element 822.

In combination, first the bottom and the lateral boards 1, and 2 are joined together with the lower hooked engaging protrusions 21 engaging the insertion holes 11, and then the lower back board 3 is secured to the bottom board 1 with the insertion posts 31 being inserted into the insertion holes 12, and with screws 321 being screwed into the through holes 32 and the screw holes 13. Second, the upper back board 4 is joined to the lower back board 3 by means of inserting the insertion posts 41 into the insertion holes 33. Third, the top board 5 is joined to the upper back board 4 by means of engaging the upper hooked engaging protrusions 22 with the engaging holes 51, and then screws 421 are screwed into the through holes 42 and the screw holes 52. Fourth, the supporting rod 6 is secured to the lateral boards 2 by means of screws 611, which are screwed into the through holes 61 and the screw holes 23. The separating board 7 is positioned between the lateral boards 2, and held in position with the rear engaging portion 71 and the front edge thereof being supported on the supporting protrusions 43, and 62 respectively. The lower pivotal posts 81 of the doors 8 are inserted into the pivotal holes 15 of the bottom board 1, and then the upper pivotal posts 82 are inserted into the pivotal holes 54 of the top board 5 so that the doors 8 can be pivoted on the pivotal holes 15, 15; upper and lower edges of the doors 8 will respectively fit in the step-shaped portions 14, and 53 when the doors 8 are closed; force has to be exerted on the pulled portions 821 to retreat the upper pivotal posts 82 into the doors 8 for allowing the upper pivotal posts 82 to be inserted into the pivotal holes 54. The magnetic members 83 form magnetic attraction between them and the boards 1, 5 to help the doors 8 to be closed.

Figure 7:
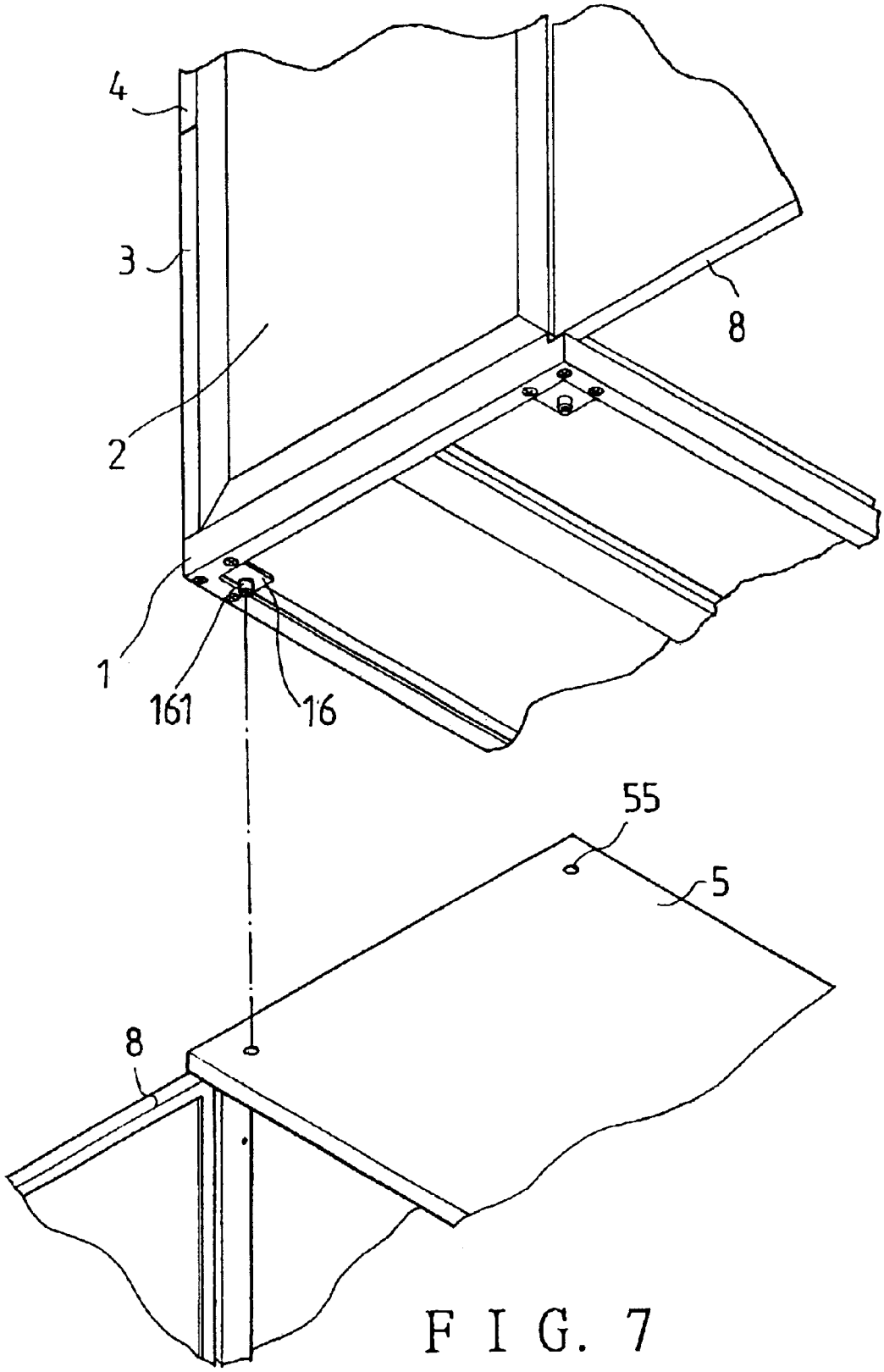
FIG. 7 is a partial perspective view of the metallic cabinet of the second embodiment in use.

The cabinet of the present invention can be used alone, as shown in FIG. 8. According to a second embodiment of the invention, a second cabinet of the kind is positioned on top of the cabinet of FIG. 8 to provide larger space for holding objects; referring to FIG. 7, connecting plates 16 are secured to four corners of the bottom of the second cabinet with posts 161 being directed downwards; the posts 161 of the second cabinet are inserted into the connecting holes 55 of the top board 5 of the cabinet of FIG. 8.

The cabinet of the present invention can be packaged with various parts thereof being not joined together because it can be easily assembled by consumers at home. Consequently, a consumer can take a cabinet of the kind home easily after buying the same, and cabinets of the kind occupy less space in transportation, delivery, and storage, saving the manufacturers a lot of cost.

What is claimed is:

1. A metallic cabinet, comprising:

a bottom board as a bottom of the cabinet; two lateral boards detachably joined to the bottom board as lateral portions of the cabinet;

a lower rear board detachably joined to the bottom board as a rear portion of the cabinet;

a top board detachably joined to the lateral boards as an upper portion of the cabinet;

an upper rear board detachably joined to the lower rear board as a rear portion of the cabinet, the upper rear board having a supporting protrusion near to a lower edge of an inward side thereof;

a supporting rod detachably joined to inward sides of the lateral boards at two ends thereof, the supporting rod having a supporting protrusion formed on an inward edge thereof and substantially as high as the supporting protrusion of the upper rear board;

a separating board held in position between the lateral boards with front and rear edges thereof being supported on the supporting protrusions; and at least one door detachably pivoted to the bottom board and the top board by posts respectively arranged at upper and lower ends of the door, the upper post of the door being biased upwardly to project from the upper end of the door, and is formed with a pulled portion for allowing an external force to be exerted thereon to retract the post into the door;

the bottom, and the lateral boards respectively having engaging holes, and hooked engaging protrusions, which are shaped so as to be separably engaged with the engaging holes, formed on portions that abut each other after assembly of the cabinet;

the bottom, and the lower rear boards respectively having screw holes, and through holes formed on portions that abut each other after assembly of the cabinet, the through holes being aligned with corresponding ones of the screw holes for allowing screws to be screwed therein;

the lower and the upper rear boards respectively having insertion holes, and posts, which are made so as to be separably inserted into the insertion holes, formed on portions that abut each other after assembly of the cabinet;

the top, and the upper rear boards respectively having screw holes, and through holes formed on portions that abut each other after assembly of the cabinet, the through holes being aligned with corresponding ones of the screw holes for allowing screws to be screwed therein;

the top, and the lateral boards respectively having engaging holes, and hooked engaging protrusions, which are shared so as to be separably engaged with the engaging holes, formed on portions that abut each other after assembly of the cabinet.

2. A metallic cabinet, comprising:

a bottom board as a bottom of a first cabinet structure;

two lateral boards detachably joined to the bottom board as lateral portions of the first cabinet structure;

a lower rear board detachably joined to the bottom board as a rear portion of the first cabinet structure;

a top board detachably joined to the lateral boards as an upper portion of the first cabinet structure;

an upper rear board detachably joined to the lower rear board as a rear portion of the first cabinet structure, the upper rear board having a supporting protrusion near to a lower edge of an inward side thereof;

a supporting rod detachably joined to inward sides of the lateral boards at two ends thereof, the supporting rod having a supporting protrusion formed on an inward edge thereof and substantially as high as the supporting protrusion of the upper rear board;

a separating board held in position between the lateral boards with front and rear edges thereof being supported on the supporting protrusions;

at least one door detachably pivoted to the bottom board, and the top board at posts arranged at upper and lower ends thereof respectively;

the bottom, and the lateral boards respectively having engaging holes, and hooked engaging protrusions, which are shaped so as to be separably engaged with the engaging holes, formed on portions that abut each other after assembly of the first cabinet structure;

the bottom, and the lower rear boards respectively having screw holes, and through holes formed on portions that abut each other after assembly of the first cabinet structure, the through holes being aligned with corresponding ones of the screw holes for allowing screws to be screwed therein;

the lower and the upper rear boards respectively having insertion holes, and posts, which are made so as to be separably inserted into the insertion holes, formed on portions that abut each other after assembly of the first cabinet structure;

the top, and the upper rear boards respectively having screw holes, and through holes formed on portions that abut each other after assembly of the first cabinet structure, the through holes being aligned with corresponding ones of the screw holes for allowing screws to be screwed therein;

the top, and the lateral boards respectively having engaging holes, and hooked engaging protrusions, which are shaped so as to be separably engaged with the engaging holes, formed on portions that abut each other after assembly of the first cabinet structure;

a second cabinet structure being substantially identical to the first cabinet structure; and, a plurality of connecting plates being secured to four corners of a bottom of a bottom board of the second cabinet structure, each of the connecting plates having a post directed downwardly and an upper side of the top board of the first cabinet structure having holes on four corners thereof, the second cabinet structure being positioned on the first cabinet structure with the posts on four bottom corners of the bottom board of the second cabinet structure being inserted into the corresponding holes on four corners of the top board of the first cabinet structure.

3. A metallic cabinet, comprising:

a bottom board as a bottom of the cabinet;

two lateral boards detachably joined to the bottom board as lateral portions of the cabinet;

a lower rear board detachably joined to the bottom board as a rear portion of the cabinet;

a top board detachably joined to the lateral boards as an upper portion of the cabinet;

an upper rear board detachably joined to the lower rear board as a rear portion of the cabinet, the upper rear board having a supporting protrusion near to a lower edge of an inward side thereof;

a supporting rod detachably joined to inward sides of the lateral boards at two ends thereof, the supporting rod having a supporting protrusion formed on an inward edge thereof and substantially as high as the supporting protrusion of the upper rear board;

a separating board held in position between the lateral boards with front and rear edges thereof being supported on the supporting protrusions;

at least one door detachably pivoted to the bottom board and the top board by posts respectively arranged at upper and lower ends of the door;

the bottom, and the lateral boards respectively having engaging holes, and hooked engaging protrusions, which are shaped so as to be separable engaged with the engaging holes, formed on portions that abut each other after assembly of the cabinet;

the bottom, and the lower rear boards respectively having screw holes, and through holes formed on portions that abut each other after assembly of the cabinet, the through holes being aligned with corresponding ones of the screw holes for allowing screws to be screwed therein;

the lower and the upper rear boards respectively having insertion holes, and posts, which are made so as to be separably inserted into the insertion holes, formed on portions that abut each other after assembly of the cabinet;

the top, and the upper rear boards respectively having screw holes, and through holes formed on portions that abut each other after assembly of the cabinet, the through holes being aligned with corresponding ones of the screw holes for allowing screws to be screwed therein;

the top, and the lateral boards respectively having engaging holes, and hooked engaging protrusions, which are shaped so as to be separably engaged with the engaging holes, formed on portions that abut each other after assembly of the cabinet; and, a plurality of connecting plates secured to four corners of a bottom of the bottom board, each of the connecting plates having a screw hole formed therein for receiving a leg is screwed therein.

* * * * *